US006378502B1

(12) United States Patent
Betz

(10) Patent No.: US 6,378,502 B1
(45) Date of Patent: Apr. 30, 2002

(54) FUEL INJECTION VALVE FOR HIGH-PRESSURE FUEL INJECTION

(75) Inventor: Lorenz Betz, Burgebrach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/622,718

(22) PCT Filed: Dec. 8, 1999

(86) PCT No.: PCT/DE99/03913

§ 371 Date: Oct. 2, 2000

§ 102(e) Date: Oct. 2, 2000

(87) PCT Pub. No.: WO00/37793

PCT Pub. Date: Jun. 29, 2000

(30) Foreign Application Priority Data

Dec. 22, 1998 (DE) ..... 198 59 484

(51) Int. Cl.[7] ..... F02M 37/04
(52) U.S. Cl. ..... 123/467; 123/501
(58) Field of Search ..... 123/467, 500, 123/501, 458; 137/539; 251/129.14

(56) References Cited

U.S. PATENT DOCUMENTS 4,018,419 A * 4/1977 Monpetit ..... 251/65
4,527,744 A * 7/1985 Hafner et al. ..... 239/585.3
4,655,396 A * 4/1987 Taxon et al. ..... 239/585.3
5,197,675 A * 3/1993 Daly ..... 239/585.2
5,370,320 A * 12/1994 Sofer ..... 239/585.1
5,556,175 A * 9/1996 Hayakawa et al. ..... 303/119.2
5,950,600 A * 9/1999 Ricco ..... 123/467
6,129,072 A * 10/2000 Graves ..... 123/446
6,142,443 A * 11/2000 Potschin et al. ..... 251/57

* cited by examiner

*Primary Examiner*—Carl S. Miller
(74) *Attorney, Agent, or Firm*—Ronald E. Greigg

(57) ABSTRACT

An improved fuel injection valve for a high-pressure injection of fuel from a central high-pressure line into combustion chambers of an internal combustion engine, which has an injection valve with a valve seat, a valve ball, and a guide piece that guides the valve ball. The guide piece presses the valve ball against the valve seat in order to close the injection control valve and during the opening, subjects the valve ball to an initial stress of a spring. During the opening, the valve ball is lifted up from the valve seat by means of a high-pressure jet which is supplied via an outlet throttle bore by a control chamber that is operatively connected with a central high-pressure line. A diffuser is disposed between the valve seat and the outlet throttle bore, and the outlet throttle bore, the diffuser, and the valve seat have the approximate shape of a steep-walled funnel with a right-angled to acute-angled cone angle.

20 Claims, 3 Drawing Sheets

FUEL INJECTION VALVE FOR HIGH-PRESSURE FUEL INJECTION

BACKGROUND OF THE INVENTION

1. Field of the Invention

This invention relates to fuel injection valves, and more particulary to a fuel injection; valve for a high-pressure injection.

2. Description of the Prior Art

An injection valve of the type with which this invention is concerned has been disclosed in European patent application 0 661 442 A1. Fuel injection valves of this kind have a control chamber which, by means of an inlet throttle bore, continuously communicates with a high-pressure fuel source by way of a high-pressure line. A valve closing member of the fuel injection valve is kept in the closed position as long as the control pressure prevailing in the control chamber is high.

The control chamber can be discharged by means of an outlet throttle bore which is acted upon by an injection control valve. As soon as the injection control valve opens the outlet throttle bore, the control chamber is discharged and the valve closing member of the fuel injection valve switches into its open position so that the injection into a combustion chamber of an internal combustion engine can take place. When the injection control valve closes the outlet throttle bore again, the valve closing member is brought back into the closed position as a result of the pressure increase in the control chamber.

Speed, precision, and reproducibility of the opening and closing movements of the injection control valve are of crucial importance for the quality of the fuel injection. The reproducibility of the opening and closing movements is decisively determined by the design of the injection control valve that is essentially a valve seat that in order to open and close the outlet throttle bore, cooperates with a valve ball that is pressed against the valve seat by a guide piece in order to close and open the injection control valve or is subjected to an initial stress of a spring in order to open it.

A recess in the guide piece that guides the valve ball is in fact adapted to the diameter of the valve ball, but radial displacements of the ball in relation to the ball seat can occur if the high-pressure jet at the outlet throttle bore strikes the valve ball in a radially offset manner. Furthermore transient effects can occur until the ball is lifted up centrally from the valve seat and finally, the embodiment of the valve seat as a flat cone does not assure that the valve ball will close the valve seat without radial displacement and without the occurrence of transient effects during the closing process.

FIG. 3 shows a detail of a typical embodiment of the essential constructive parts of an injection control valve. By means of the crimped screw connection 11, the fuel injection valve is connected to the central high-pressure line 6 which in turn communicates with a high-pressure fuel source. By means of an inlet throttle bore 10, a control chamber 7 is placed under high-pressure which acts on a valve closing member 12 that keeps the fuel injection valve closed as long as the high pressure prevails in the high-pressure control chamber. By means of a discharge bore that transitions into an outlet throttle bore 8, the control chamber 7 can be discharged so that the valve closing member opens the fuel injection valve and fuel from the central high-pressure line 6 is injected into the combustion chambers of an internal combustion engine. The opening and closing of the outlet throttle bore 8 is assured by means of an injection control valve that has a valve seat 2, a valve ball 3, and a guide piece 4 that guides the valve ball 3. The flat cone-shaped valve seat with an obtuse opening angle $\alpha$ can also be clearly seen here, which has also been disclosed by the reference EP 0 661 442 A1 in FIG. 2.

Each occurrence of transient effects and/or of radial displacements of the valve ball in relation to the center of the centrally disposed outlet throttle bore reduces the precision and reproducibility of the opening and closing movements of the injection control valve.

The object of the invention, therefore, is to overcome the disadvantages of fuel injection valves of the prior art, to assure a reliable, uniform closing of the valve ball in the injection control valve, and to reduce distortions due to transient effects or other obstructions to the valve ball during the closing of the injection control valve.

SUMMARY OF THE INVENTION

The disposition of a diffuser between the valve seat and the outlet throttle bore advantageously achieves the fact that compared to the embodiment according to EP 0 661 442 A1, a higher percentage of the kinetic energy of the high-pressure jet emerging from the throttle bore is converted into static pressure. Consequently, due to the greater average diameter of the diffuser in relation to the throttle bore, the pressure contacts a greater service area of the valve ball as it is opening. Consequently, the valve ball is uniformly and reproducibly centered as it is lifting up and radial displacements of the valve ball in relation to the outlet throttle bore can be prevented to the greatest extent possible.

The embodiment approximately in the shape of a steep-walled funnel composed of the outlet throttle bore, diffuser, and valve seat, in which the funnel shape has a right-angled to acute-angled cone angle a, advantageously achieves the fact that in contrast to the conventional valve seat composed of a flat cone with an outlet throttle bore disposed centrally at the tip of the cone, the funnel wall of the valve seat encourages the centering of the valve ball during the closing of the injection control valve and prevents a radial displacement of the valve ball in relation to the diffuser and the outlet throttle bore. Consequently, the embodiment according to the invention of the injection control valve in the fuel injection valve achieves an increased precision and reproducibility of the opening and closing movement.

Usually, the diffuser is a constant widening from a minimal diameter to a maximal diameter. In this connection, increasingly and steadily, the kinetic energy of a flowing medium is partially converted into static pressure. In a preferred embodiment of the invention, the diffuser is embodied as a "cross sectional jump", i.e. the minimal and maximal diameter of the diffuser are equal. This represents an inconstant widening of the outlet throttle bore to the diameter of the diffuser, which is normally referred to as a Carnot opening. A Carnot opening of this kind has the advantage that the resistance coefficient æ can be optimized by means of simply changing the ratio between the diameter of the diffuser and the diameter of the outlet throttle bore.

In a preferred embodiment of the invention, the ratio between the average diameter of the diffuser and the diameter of the outlet throttle bore lies between 1.2 and 2 so that the resistance coefficient æ can be set between about 0.16 and about 9.

In another preferred embodiment of the invention, the cone angle æ is 60° to 90°. In contrast to the flat cone known from the prior art, this steep-walled cone permits an improved centering of the valve ball. With cone angles of greater than 60°, the centering of the valve ball is in fact more strongly encouraged, but the ball cannot protrude into the diffuser far enough to be suspended as close as possible to the outlet throttle bore when the injection control valve is closed. On the other hand, with cone angles$\alpha$ of greater than 90°, the centering action of the funnel shape becomes increasingly less effective so that there is an increase in the disadvantages explained above for the prior art.

Preferably, the valve ball protrudes with between ⅕ and 1/10 of its radius r into the diffuser. This can advantageously result in the fact that on the one hand, a sufficiently large spherical cap of the valve ball is struck by the high-pressure jet and lifted up from the valve seat in a centered fashion and on the other hand, the valve ball is prevented from protruding too far into the diffuser.

In another embodiment of the invention, the maximal diameter D of the diffuser and the length 1 of the diffuser are matched to one another in such a way that when the injection valve is closed, the valve ball is positioned at a distance of ≦0.1 mm, preferably between 30 and 80 $\mu$m, above the outlet throttle bore. This spacing preferably assures that during the opening of the injection control valve, not only does the high-pressure jet from the outlet throttle bore initially act on the valve ball surface in the vicinity of the throttle bore, but also the pressure acts on the larger surface area of a spherical cap of the valve ball in the vicinity of the maximal diameter of the diffuser or of the valve seat.

The length-to-diameter ratio of the outlet throttle bore is crucial for the percentage of the throttling action. The smaller the diameter and the greater the length of the throttle bore, the more intense the throttling action is. Increasing throttling action also results in a reduced consumption of the fuel emerging from the control chamber. At the same time, however, the time required to decrease the high pressure in the control chamber increases. Therefore, the range from 1 to 20 for the length-to-diameter ratio of the outlet throttle bore represents an optimal compromise between these two extremes.

Furthermore, the diffuser preferably has a length-to-maximal diameter ratio between 0.1 and 0.5. This length-to-maximal diameter ratio of the diffuser results in the fact that the flow does not come into contact with the casing-shaped wall of the diffuser so that the frictional losses in the diffuser become negligibly small while the flow losses increase due to turbulence generation at the step-shaped transition.

BRIEF DESCRIPTION OF THE DRAWINGS

Other advantages, features, and potential applications of the current invention will be apparent from the following description taken in connection with the drawings, in which.

DESCRIPTION OF THE PREFERRED EMBODIMENTS

Figure 1:
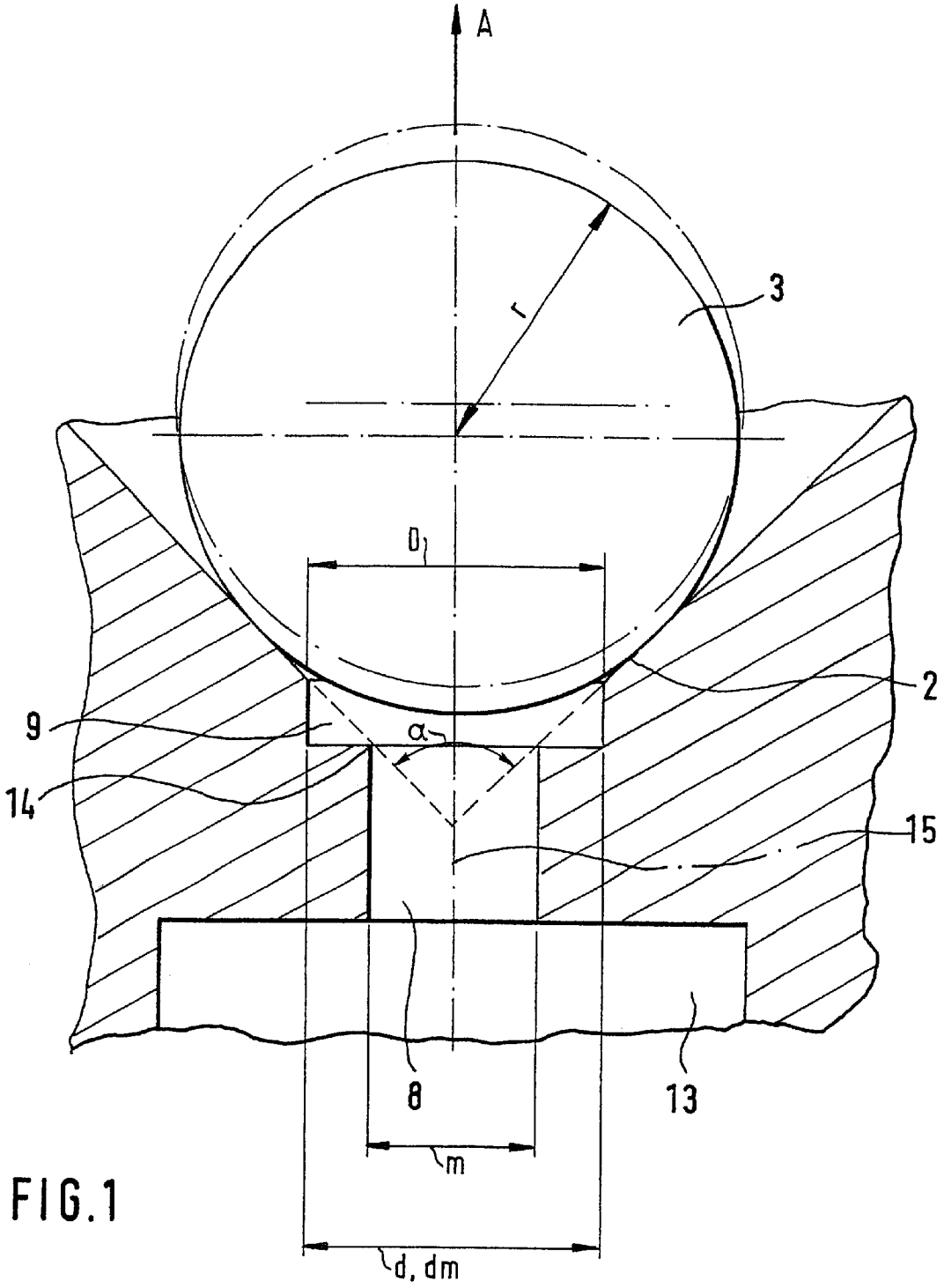
FIG. 1 shows a cross-section through a fuel injection valve in the vicinity of a valve seat of an injection control valve in a first embodiment of the invention.

Referring now to the drawings in detail,

FIG. 1 shows a cross section through a fuel injection valve in the vicinity of a valve seat 2 of an injection control valve in a first embodiment of the invention. A pressure chamber 7 communicates with a central high-pressure line 6 by means of an inlet throttle bore 10 shown in FIG. 3 and is therefore subjected to a fuel pressure between 150 and 300 MPa. A discharge bore 13, which transitions into an outlet throttle bore 8, can be used to discharge the control chamber 7 when the valve ball 3 of the injection control valve lifts up from the valve seat 2 in the arrow direction A counter to an initial stress of a spring 5.

Figure 3:
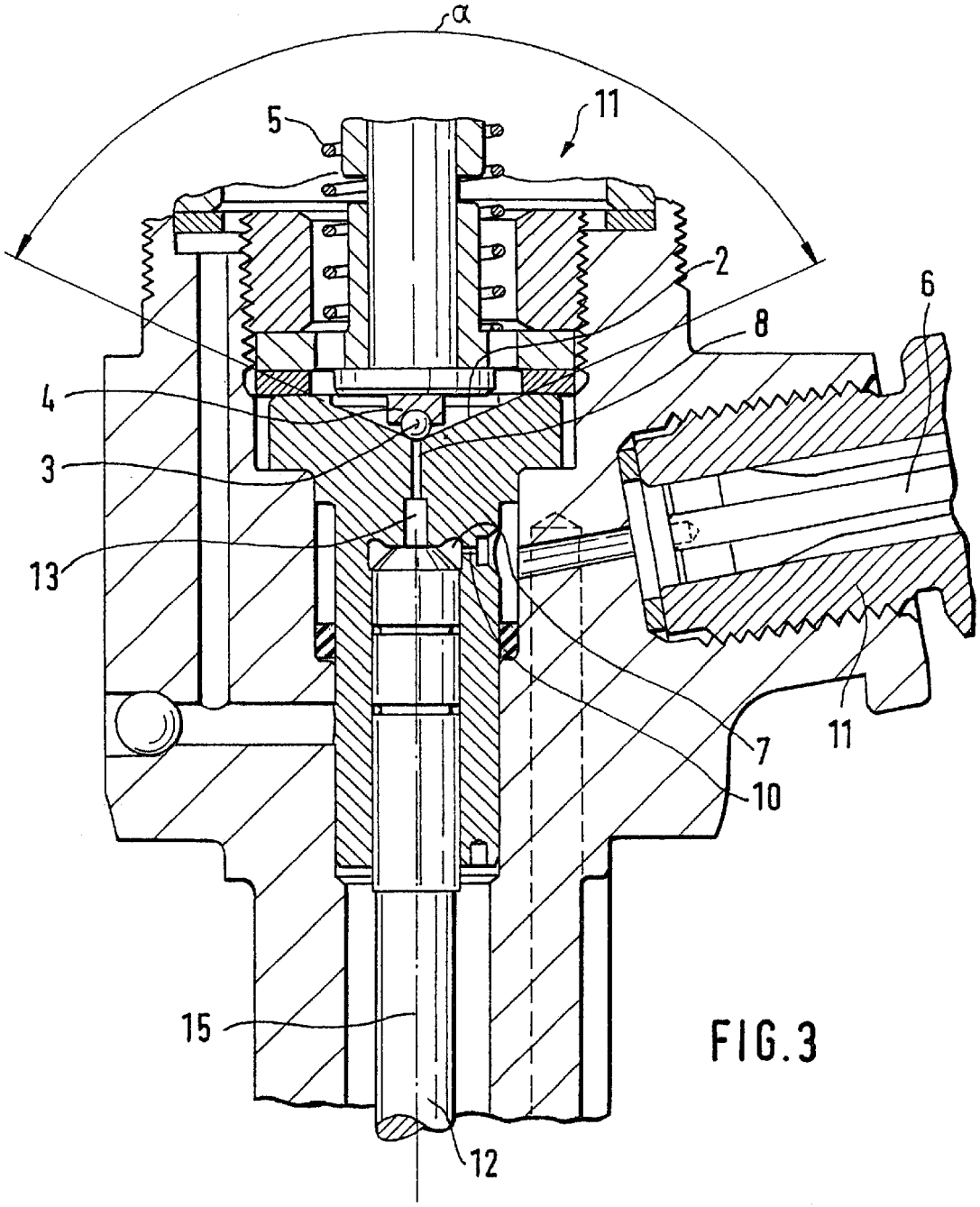
FIG. 3 shows a detailed cross section the vicinity of the essential structural parts of a conventional injection control valve.

During opening and closing, the valve ball 3 is secured by a guide piece 4 shown in FIG. 3, which guides the valve ball 3. The centering of the ball 3 in relation to the valve seat 2 is essentially assured by means of a steep-walled funnel shape which has a right-angled to acute-angled cone angle $\alpha$, which is 90° in this preferred embodiment. As a result, the high-pressure jet from the outlet throttle bore 8 can advantageously strike the valve ball 3 centrally and can lift it up in the arrow direction A as soon as a solenoid valve relieves the valve ball 3 from a pressure against the valve seat 2. A diffuser 9 is disposed between the valve seat 2 and the outlet throttle bore 8 and in this embodiment, the minimal diameter d and the maximal diameter D of the diffuser 9 are equal.

In this embodiment, the length-to-diameter ratio of the diffuser 9 is 0.2 and the length-to-diameter ratio of the outlet throttle bore 8 is <2. The valve ball 3 protrudes with an eighth of its radius r into the diffuser 9 and when the injection control valve is closed, is positioned at a distance of 80 $\mu$m above the throttle bore. The cross-sectional widening between the outlet throttle bore and diffuser 9 constitutes a Carnot opening in which the flow of the high-pressure jet, which is directed from the outlet throttle bore 8 toward the center of the valve ball 3, no longer contacts the walls of the diffuser 9 in a laminar fashion, but produces loss-encumbered flow turbulence at the cross-sectional widening.

Despite these flow losses, the diffuser 9, in connection with the steep-walled valve seat 2, has a significantly greater centering action on the valve ball 3 than the onventional flat cone-shaped valve seat in connection with an immediate transition from the outlet throttle bore 8 to the valve seat 2 in the prior art.

Figure 2:
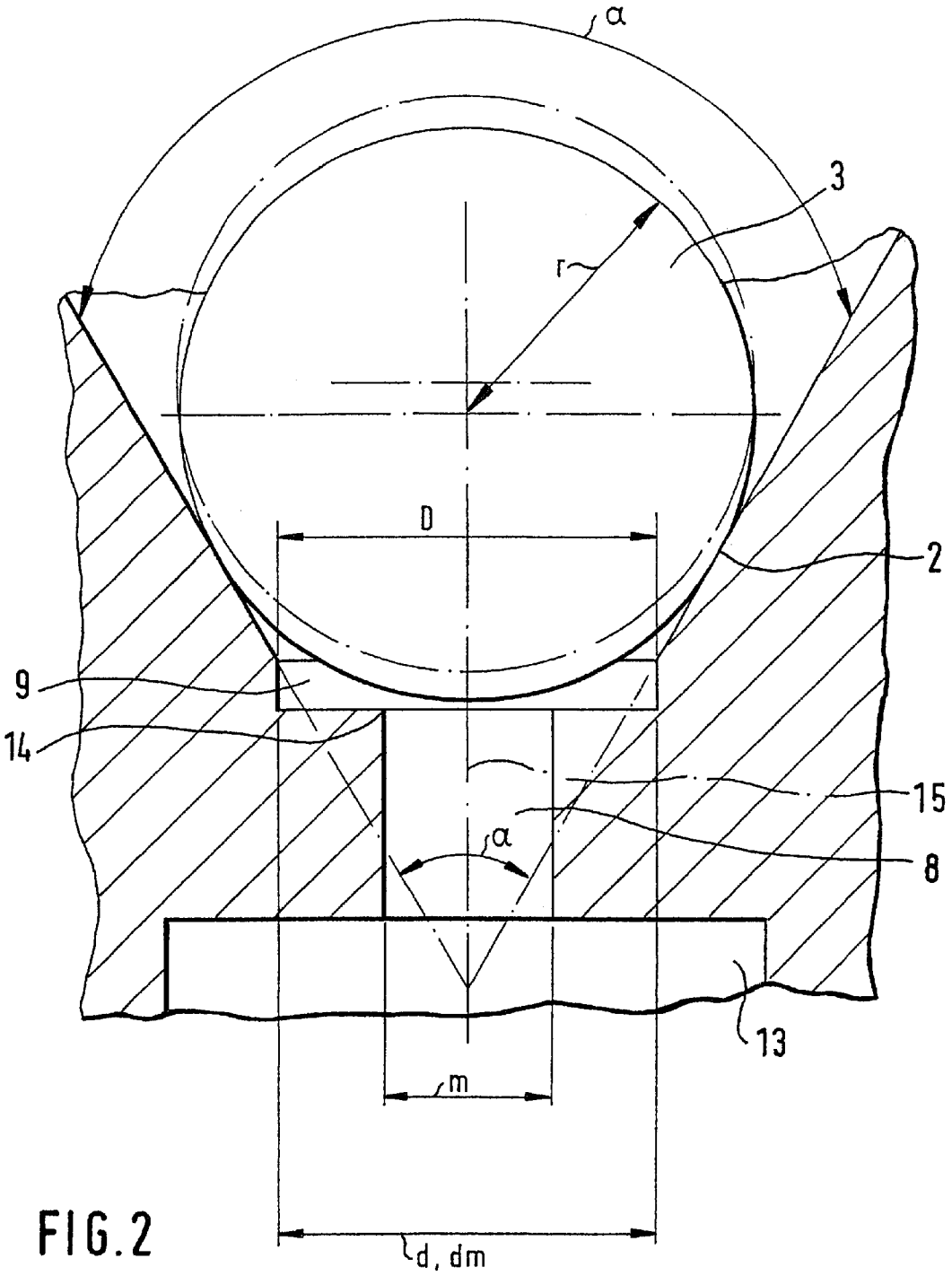
FIG. 2 shows a cross section through a fuel injection valve in the vicinity of a valve seat of an injection control valve in a second embodiment of the invention.

FIG. 2 shows a cross section through the fuel injection valve in the vicinity of the valve seat of the injection control valve in a second embodiment of the invention. As is apparent in this embodiment, the cone angle $\alpha$ is significantly more acute than in the first embodiment according to FIG. 1. In this instance, the cone angle $\alpha$=60° and the length-to-diameter ratio of the diffuser is 0.15.

In this exemplary embodiment, the valve ball 3 protrudes significantly further into the diffuser 9 and when the injection control valve is closed, is suspended 30 $\mu$m above the outlet rim 14 of the outlet throttle bore 8. This acute-angled cone of the valve seat 2 centers the valve ball 3 hydraulically. This means that the closing can take place in a frictionless manner and distortions in the return quantity do not occur during the closing of the valve ball 3. The extremely short diffuser bore with a length-to-diameter ratio of 0.15 permits the high-pressure jet emerging from the outlet throttle bore 8 to strike the ball not significantly outside the center line 15. This results in further reduced radial forces. Furthermore, the relatively large diffuser bore has the advantage that the steep-walled valve seat 2 can be better machined and polished.

FIG. 3 shows a detailed cross section the vicinity of the essential structural parts of the conventional injection control valve as extensively described above in the prior art section.

The foregoing relates to preferred exemplary embodiments of the invention, it being understood that other variants and embodiments thereof are possible within the spirit and scope of the invention, the latter being defined by the appended claims.

I claim:

1. A fuel injection valve for a high-pressure injection of fuel from a central high-pressure line (6) into combustion chambers of an internal combustion engine, including an injection valve (1) with a valve seat (2), a valve ball (3), and a guide piece (4) that guides the valve ball (3), which guide piece presses the valve ball (3) against the valve seat (2) in order to close the valve and, in order to open the valve, subjects the valve ball (3) to an initial stress of a spring (5), and in the open state, permits the valve ball (3) to be lifted up from the valve seat (2) by means of a high-pressure jet which is supplied via an outlet throttle bore (8) by a control chamber (7) that communicates with a central high-pressure line (6), the improvement comprising a diffuser (9) disposed between the valve seat (2) and the outlet throttle bore (8), said outlet throttle bore (8), said diffuser (9), and said valve seat (2) having the approximate shape of a steep-walled funnel with a right-angled to acute-angled cone angle ($\alpha$).

2. The fuel injection valve according to claim 1, wherein the minimal diameter (d) and the maximal diameter (D) of the diffuser (9) are equal.

3. The fuel injection valve according to claim 1, wherein the ratio between an average diameter $d_m$ of the diffuser (9) and a diameter (m) of the outlet throttle bore (8) lies between 1.2 and 2.

4. The fuel injection valve according to claim 1, wherein the cone angle ($\alpha$) is within the range about 60 to 90°.

5. The fuel injection valve according to claim 1, wherein the valve ball (3) protrudes with between ⅕ and 1/10 of its radius (r) into the diffuser (9).

6. The fuel injection valve according to claim 1, wherein the maximal diameter (D) of the diffuser (9) and the length of the diffuser (9) are matched to one another in such a way that when the injection valve (1) is closed, the valve ball (3) is positioned at a distance of ≦0.1 mm.

7. The fuel injection valve according to claim 6, wherein the valve ball (3) is positioned at a distance of between 30 and 80 $\mu$m, above the outlet throttle bore (8).

8. The fuel injection valve according to claim 1, wherein outlet throttle bore has a length-to-diameter ratio between 1 and 20.

9. The fuel injection valve according to claim 1, wherein the diffuser (9) has a length-to-maximal diameter ratio between 0.1 and 0.5.

10. The fuel injection valve according to claim 2, wherein the ratio between an average diameter $d_m$ of the diffuser (9) and a diameter (m) of the outlet throttle bore (8) lies between 1.2 and 2.

11. The fuel injection valve according to claim 10, wherein the cone angle ($\alpha$) is within the range about 60 to 900.

12. The fuel injection valve according to claim 11, wherein the valve ball (3) protrudes with between ⅕ and 1/10 of its radius (r) into the diffuser (9).

13. The fuel injection valve according to claim 11, wherein the maximal diameter (D) of the diffuser (9) and the length of the diffuser (9) are matched to one another in such a way that when the injection valve (1) is closed, the valve ball (3) is positioned at a distance of ≦0.1 mm.

14. The fuel injection valve according to claim 12, wherein the valve ball (3) is positioned at a distance of between 30 and 80 $\mu$m, above the outlet throttle bore (8).

15. The fuel injection valve according to claim 14, wherein outlet throttle bore has a length-to-diameter ratio between 1 and 20.

16. The fuel injection valve according to claim 15, wherein the diffuser (9) has a length-to-maximal diameter ratio between 0.1 and 0.5.

17. The fuel injection valve according to claim 2, wherein the cone angle ($\alpha$) is in the range about 60 to 90°.

18. The fuel injection valve according to claim 3, wherein the maximal diameter (D) he diffuser (9) and the length of the diffuser (9) are matched to one another in h a way that when the injection valve (1) is closed, the valve ball (3) is positioned distance of ≦0.1 mm.

19. The fuel injection valve according to claim 18, wherein outlet throttle bore has a length-to-diameter ratio between 1 and 20.

20. The fuel injection valve according to claim 19, wherein the diffuser (9) has a length-to-maximal diameter ratio between 0.1 and 0.5.

* * * * *